US005761775A

United States Patent [19]

Legome et al.

[11] Patent Number: 5,761,775

[45] Date of Patent: Jun. 9, 1998

[54] MUSHROOM AND LOOP MATERIAL CLOSURE SYSTEM FOR HIGH SHEAR STRENGTH AND LOW PEEL STRENGTH APPLICATIONS

[76] Inventors: Mark J. Legome, 27 Spoon La., Coto De Čaza, Calif. 92679; Georgia L. Conrad, 27652 Via Rodrigo, Mission Viejo, Calif. 92692; Michael R. Laurenson, 770 Nyes Pl., Laguna Beach, Calif. 92651

[21] Appl. No.: 734,414

[22] Filed: Oct. 17, 1996

[51] Int. Cl.[6] ..... A44B 17/00

[52] U.S. Cl. ..... 24/450; 24/306; 24/442

[58] Field of Search ..... 24/306, 442–452, 24/575–577

[56] References Cited

U.S. PATENT DOCUMENTS

| | | | |
|---|---|---|---|
| 3,320,649 | 5/1967 | Naimer | 28/72 |
| 3,408,705 | 11/1968 | Kayser et al. | 24/452 |
| 3,577,607 | 5/1971 | Ikoma | 24/204 |
| 3,708,837 | 1/1973 | Chiba | 24/204 |
| 4,308,642 | 1/1982 | Heyman | 24/306 |
| 4,454,183 | 6/1984 | Wollman | 428/92 |
| 4,543,947 | 10/1985 | Blackstone | 128/75 |
| 4,710,414 | 12/1987 | Northrup et al. | 428/43 |
| 4,784,890 | 11/1988 | Black | 428/100 |
| 4,894,060 | 1/1990 | Nestegard | 604/391 |
| 4,984,339 | 1/1991 | Provost et al. | 24/452 |
| 5,032,122 | 7/1991 | Noel et al. | 604/391 |
| 5,040,275 | 8/1991 | Eckhardt et al. | 24/442 X |
| 5,058,245 | 10/1991 | Saito | 24/306 |
| 5,077,870 | 1/1992 | Melby et al. | 24/452 |
| 5,133,122 | 7/1992 | Gomez-Acevedo | 24/450 |
| 5,149,573 | 9/1992 | Kobe et al. | 24/448 X |
| 5,339,499 | 8/1994 | Kennedy et al. | 24/452 |
| 5,369,852 | 12/1994 | Higashinaka | 24/450 X |
| 5,500,268 | 3/1996 | Billarant | 428/100 |
| 5,537,720 | 7/1996 | Takizawa et al. | 24/452 |
| 5,625,929 | 5/1997 | Hattori et al. | 24/452 |

*Primary Examiner*—James R. Brittain
*Assistant Examiner*—Robert J. Sandy
*Attorney, Agent, or Firm*—Cislo & Thomas

[57] ABSTRACT

A closure system for any nondiposable item or device requiring high shear strength, and acceptable peel strength, in all directions includes a first closure element having a backing sheet with mushroom-shaped elements fixed to and extending from one side thereof, and a second closure element having a backing sheet with loop elements fixed to and extending from one side thereof. The loops are uniformly, randomly or irregularly oriented for engaging the mushrooms in a variety of random orientations to provide high, comparable shear strength in all directions. The mushrooms are randomly or irregularly oriented depending upon desired shear and peel strength characteristics.

17 Claims, 2 Drawing Sheets

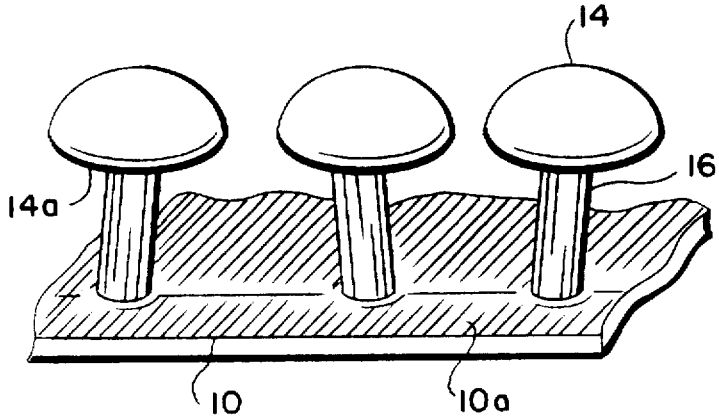
FIG. 3
FIG. 4
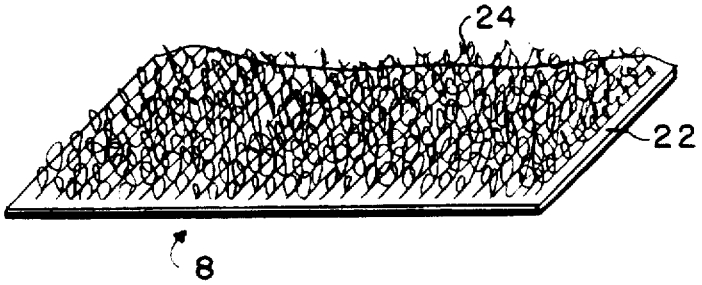
FIG. 5
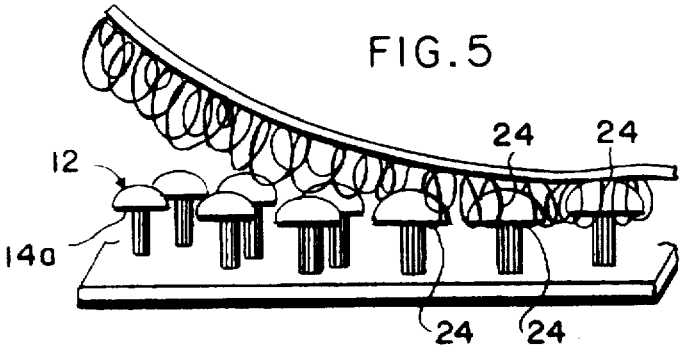
FIG. 6
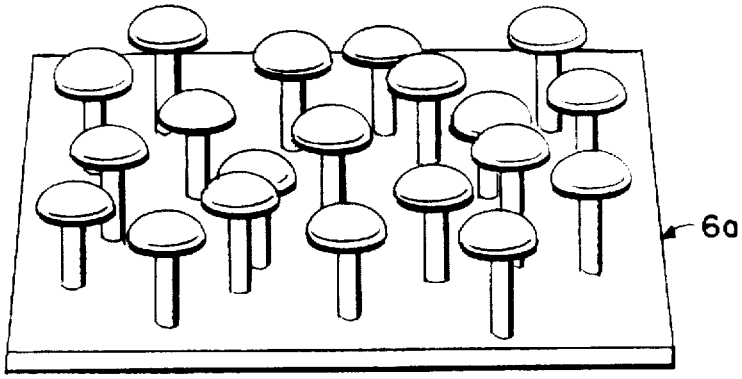

MUSHROOM AND LOOP MATERIAL CLOSURE SYSTEM FOR HIGH SHEAR STRENGTH AND LOW PEEL STRENGTH APPLICATIONS

BACKGROUND OF THE INVENTION

The present invention relates to a mushroom and loop material closure system, and in particular, to such a system for high shear strength and low peel strength applications such as nondisposable, medical, consumer, military and other applications.

Hook and loop material fasteners are widely used for clothing, fanny packs, and many other consumer articles. One example of this type of fastener is sold under the Trademark VELCRO®. There are many methods of making the hooks and loops. For example, U.S. Pat. No. 5,032,122 (Noel, et al.) discloses hooks which are in the form of mushroom-shaped elements, which will engage loops or filaments which are essentially parallel. The goal of the Noel et al. patent is to create low cost loop elements so that the closure system can be sufficiently economical for disposable items. The closure system is intended to hold during normal use but be readily peeled in a direction normal to the plane of engagement of the filaments and hooks. In certain applications, however, where an item is subject to multiple directions of forces and is desired to continuously hold in a secure manner, yet provide the highly adjustable closure system of VELCRO® and similar systems, the conventional systems do not provide sufficient multi-directional shear strength. Moreover, the shear strength of VELCRO® and similar systems is relatively low for nondisposable medical, consumer, and military applications which require ease of fastening yet a high degree of shear strength. For example, a company known as Professional Lumbar Support makes lumbar-sacroiliac braces using purportedly strong VELCRO® fasteners, yet still does not achieve "high shear strength." Accordingly, it is desirable to develop a variation of a hook and loop type of closure system which provides shear strength which is uniformly high regardless of the shear direction and which provides a very secure engagement. For example, current systems, if used in medical applications such as neck or back braces, to be worn continuously overnight and over a period of weeks or longer, would have a tendency to shear (slip) or peel, particularly when worn while the patient is actively moving, or rubbing against something, such as a bed or a chair.

SUMMARY OF THE INVENTION

In one embodiment, the invention provides a secure but releasable closure system for a nondisposable device such as a medical device. The system includes a first closure element having a base or backing sheet with mushroom-shaped elements fixed to or unitary with and extending from one side thereof. A second closure element has a backing sheet with loop elements fixed to or unitary with and extending from one side for engaging with the mushroom-shaped elements to fix the two closure elements together. The mushroom elements are laid out randomly or in an irregular pattern, so that engagement between the loop and mushroom elements will occur in a large variety of random or irregular orientations to provide enhanced shear strength in all directions, in combination with a peel strength which is similar to existing closure systems or only a small amount larger, and well within physiologic capabilities of typical human users. In a preferred embodiment, the closure system is for a medical device such as a back support which, e.g., may be worn at work and be subjected to repeated variable loads in various directions, yet will have sufficient shear strength to avoid or minimize any risk of failure. The loop elements may be uniformly or randomly arranged.

BRIEF DESCRIPTION OF THE DRAWINGS

FIG. 3 is an enlarged side view of a portion of the first closure elements of FIG. 2, and has a resin coating thereon;

FIG. 4 is a view of a portion of the second closure element containing a loop material;

FIG. 5 is an enlarged view showing random engagement of the mushrooms and loops of the first and second closure elements of FIGS. 2 and 4; and FIG. 6 is a view of an alternate embodiment to FIG. 2.

DETAILED DESCRIPTION OF THE PREFERRED EMBODIMENT

Figure 1:
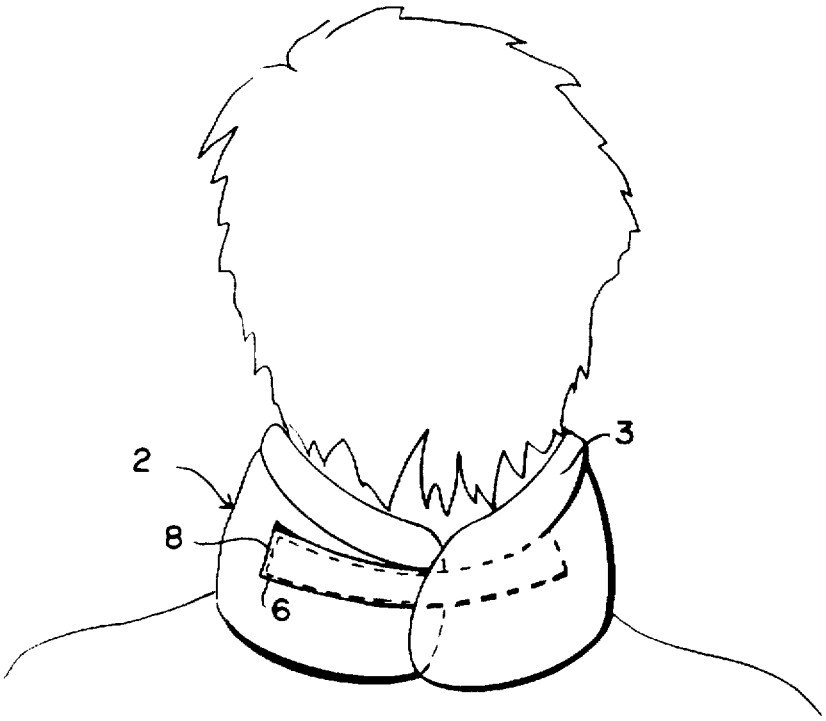
FIG. 1 is a rear view of a neck brace fastened by a closure system according to the invention.
Figure 2:
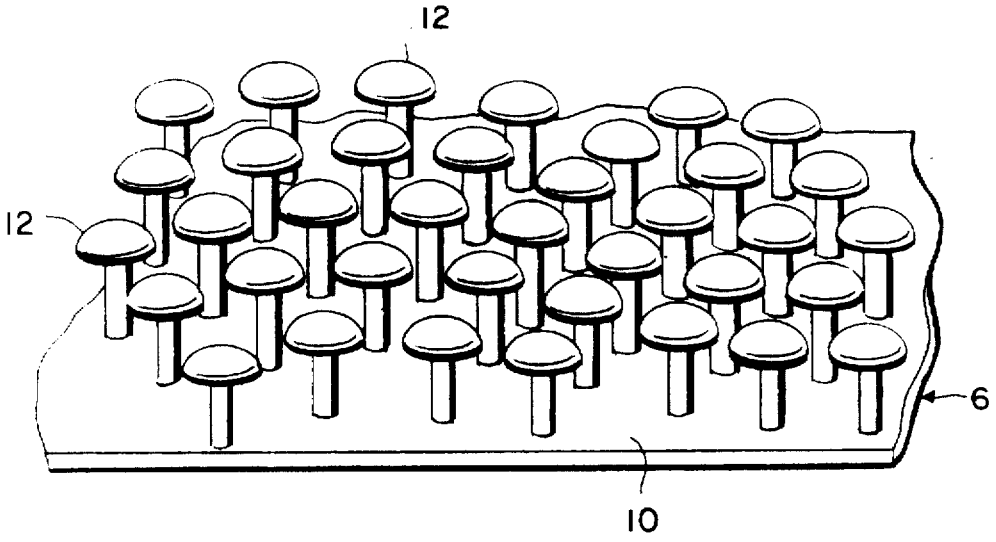
FIG. 2 is a view of one element of the closure system which contains multiple mushroom-like elements.

FIG. 1 shows a device, i.e., a nondisposable device which is an orthopedic brace incorporating a closure system according to the invention. Brace 2 is, in the illustrated embodiment, a neck brace, but the invention is equally applicable to a lumbar-sacroiliac brace or corset, as well as other devices. Brace 2 is fastened around a neck 4 of a person. The closure system has two elements, first closure element 6 and second closure element 8 for fastening to element 6. The first closure element 6 is shown in detail in FIGS. 2 and 3. It has a base or backing 10, which is preferably flexible, and has mushrooms 12 extending substantially normal to the backing. Each mushroom has a stem 16 and an enlarged head 14 with a lower engagement surface **14*a* extending beyond the stem 16 around the periphery of the stem. Suitable first closure elements may be made, for example, in accordance with U.S. Pat. No. 4,784,890 to Black and owned by 3M. The mushroom-like elements are randomly or irregularly distributed across the backing, such as an irregular pattern made by 3M (Minnesota Mining & Manufacturing Company) of St. Paul, Minn. The backing is preferably flexible and is attached to one end of the neck brace by adhesives or sewing, or other suitable attachment which is stronger than the peel strength required to peel the first and second closure elements apart. Such attachment mechanisms would be evident to one of ordinary skill in the art. The arrangement of FIG. 2 is an irregular arrangement, which in the drawing is sine wave-like parallel rows, which can be done with or without a variable mushroom separation. By contrast, FIG. 6 shows a random arrangement of mushrooms on a fastening element 6*a***.

With reference to FIG. 4, second closure element 8 is formed by loops 24 attached to a base 22. The loops may be uniformly or irregularly or randomly positioned. The second closure element or loop material is fixed to the other end of the neck brace by sewing, adhesive, or other fastening mechanism of sufficient strength.

The base 22 is also preferably flexible. A loop material such as that used in the closure system sold under the Trademark VELCRO® is suitable. An alternative second closure element is made of neoprene, which has a fuzzy side with loops.

In accordance with the invention, the orientation of the mushrooms is irregular or random. This provides for irregular or randomly oriented engagement of the engagement surface 14a of the mushrooms and the loops 24, as shown in FIG. 5, yet provides a peel strength which is within acceptable amounts for unfastening. The random or irregular orientations of the loops and mushrooms provides engagements in all directions and therefore substantially uniform and high shear strength with acceptable peel strength. This results in a fully adjustable yet continuously secure engagement in spite of movements of the wearer of the device and rubbing of the strap against, e.g., a bed or chair during rest, sleep, or sitting.

The above-described system provides strong engagement for permanent, nondisposable items of the type requiring a uniformly high level of shear strength. Therefore, the inventive closure system is particularly suitable for medical applications or any application requiring high shear strength with acceptable peel strength. Exemplary applications in which the inventive closure system may be used are closures for law enforcement bulletproof vest, naval, aeronautical or military applications for uniforms or other military gear, or consumer goods, clothing and the like which require a strong reliable closure system that is also fast and adjustable.

Information from Velcro U.S.A. shows shear and peel strength of VELCRO® brand fasteners. VELCRO Hook #88 and Loop #1000 (standard) exhibited an average 180° pull apart peel strength of 1.2 psi and an average shear strength of 14.0 psi on its length and 10.5 psi on its width. Tests on TEXACRO® fasteners using hook #70 and loop #71 made by Velcro Mexico showed an average shear strength of 13.0 psi and an average peel strength of 1.3 psi.

By contrast, tests performed on a fastener constructed in accordance with the invention using mushrooms of 1.0 mm diameter, 2.0 mm height, a 0.4 mm stem diameter and a variable or random mushroom separation of from 0.5 mm to 2.0 mm with a density of 221 mushrooms per square inch with TEXACRO® brand loop #71 (randomly disoriented loops) exhibited a peel strength of about 8.0 psi and a shear strength of over 50.0 psi, which is multiple times stronger than the VELCRO® standard and TEXACRO® fasteners.

Testing on the best VELCRO® brand loop and hook having a 2"×5" size provided a maximum shear strength of about 20 psi and a peel strength of about 4 psi. When using the invention, depending on loop density and mushroom density maximum shear strength in excess of 60.0 psi was found at which point the stitching started to fail and at about 80.0 psi the mushrooms appeared to begin failing. A table summarizing a variety of test results is set forth below:

| MATERIALS | DENSITY | SHEAR STRENGTH | PEEL STRENGTH |
|---|---|---|---|
| 1) VELCRO ® Random Hooks with Orderly ("Herringbone") loops | 480 hooks/in$^2$ 196 loops/in$^2$ | 3.60 psi | 0.8 psi |
| 2) VELCRO ® Random Hooks with random loops | 256 hooks/in$^2$ 900 loops/in$^2$ | 18.0 psi | 2 psi |
| 3) Random mushrooms with "Herringbone" loops | 256 mushrooms/in$^2$ 196 loops/in$^2$ | >50.0 psi | 5 psi |
| 4) Random mushrooms with random loops | 256 mushrooms/in$^2$ 900 loops/in$^2$ | >50.0 psi | 8 psi |
| 5) Irregular mushrooms with "Herringbone" loops | 441 mushroom/in$^2$ 196 loops/in$^2$ | >50.0 psi | 5 psi |
| 6) Irregular mushrooms with random loops | 441 mushrooms/in$^2$ 900 loops/in$^2$ | >50.0 psi | 8 psi |

Depending upon the shear and peel strength desired, loop and mushroom densities should be varied such as shown in the table.

The present invention has now been described with reference to one embodiment thereof. It will be apparent to those skilled in the art that many changes can be made in the embodiment described without departing from the spirit and scope of the present invention. Thus the scope of the present invention should not be limited to the structures described in this application, but only by structures covered by the language of the claims and equivalents to those structures.

What I claim is:

1. A secure but releasable closure system for nondisposable articles, the system comprising:

a first closure element having a base with mushroom-shaped elements fixed to and extending from one side of the base, the mushroom-shaped elements having semi-spherical heads; and a second closure element having a base with loop elements fixed to and extending from one side thereof for engaging the mushroom-shaped elements to fix the first and second closure elements together, the mushroom-shaped elements being irregular or random distances from each other for engaging the loop elements in various orientations to provide enhanced shear strength in all directions and acceptable peel strength, wherein the mushroom density is between about 256 and 441 mushrooms per square inch, and the loop density is between about 196 and 900 loops per square inch, thereby providing a shear strength of greater than 50 psi and a peel strength of between about 5 and 8 psi.

2. The system of claim 1 wherein the mushroom-shaped elements have a stem with a predetermined circumference and a head with a circumference greater than that of the stem at a point where the head and the stem meet.

3. The system of claim 1 wherein the mushroom-shaped elements are arranged in a sine wave pattern.

4. The system of claim 1 wherein the mushroom-shaped elements have a resin layer applied thereto for enhancing strength of the stem and base attachment.

5. The system of claim 1 wherein the loop elements are disposed in a random arrangement.

6. The system of claim 1, wherein the semi-spherical heads of the mushroom-shaped elements are about 1.00 mm in diameter, the mushroom-shaped elements having a height of about 2.0 mm, the stem has a diameter of about 0.4 mm, and the distance between mushroom-shaped elements varies between 0.5 mm and 2.0 mm.

7. A nondisposable device with a secure but releasable closure system, the device comprising:

a body having first and second portions; and the closure system comprising means attached to the first and second portions for fastening the first and second portions, the means comprising a first closure element having a base with mushroom-shaped elements fixed to and extending from one side thereof, the mushroom-shaped elements having semi-spherical heads and a second closure element having a base with loop elements fixed to and extending from one side thereof for engaging the mushroom-shaped elements to fix the first and second closure elements together, the loop elements being disposed in a random or irregular arrangement for engaging the mushroom-shaped elements in a variety of random orientations to provide enhanced shear strength in all directions and acceptable peel strength, wherein the mushroom density is between about 256 and 441 mushrooms per square inch, and the loop density is between about 196 and 900 loops per square inch, thereby providing a shear strength of greater than 50 psi and a peel strength of between about 5 and 8 psi.

8. The device of claim 7 wherein the mushroom-shaped elements have a stem with a predetermined circumference and a head with a circumference greater than that of the stem at a point where the head and the stem meet.

9. The device of claim 7 wherein the mushroom-shaped elements are arranged to a sine wave pattern.

10. The device of claim 7 wherein the mushroom-shaped elements have a resin layer applied thereto for enhancing strength of the stem and base attachment.

11. The device of claim 7 wherein the loop elements are disposed in a random arrangement.

12. The device of claim 7 wherein the device is a medical device.

13. The device of claim 7 wherein the first and second portions comprise free ends of the body.

14. The device of claim 7, wherein the semi-spherical heads of the mushroom-shaped elements are about 1.00 mm in diameter, the mushroom-shaped elements having a height of about 2.0 mm, the stem has a diameter of about 0.4 mm, and the distance between mushroom-shaped elements varies between 0.5 mm and 2.0 mm.

15. A nondisposable medical device with a secure but releasable closure system, the device comprising:

a body having first and second portions; and the closure system comprising means for fastening the first and second portions, the means comprising a first closure element having a base with mushroom-shaped elements fixed to and extending from one side thereof, the mushroom-shaped elements having semi-spherical heads, and a second closure element having a base with loop elements fixed to and extending from one side thereof for engaging the mushroom-shaped elements to fix the first and second closure elements together, the mushroom elements being spaced random or irregular distances from each other for engaging the loop elements in a variety of orientations to provide high shear strength in all directions and acceptable peel strength, wherein the mushroom density is between about 256 and 441 mushrooms per square inch, and the loop density is between about 196 and 900 loops per square inch, thereby providing a shear strength of greater than 50 psi and a peel strength of between about 5 and 8 psi.

16. The device of claim 15 wherein the mushroom-shaped elements are arranged in a sine wave pattern.

17. The device of claim 15, wherein the semi-spherical heads of the mushroom-shaped elements are about 1.00 mm in diameter, the mushroom-shaped elements having a height of about 2.0 mm, the stem has a diameter of about 0.4 mm, and the distance between mushroom-shaped elements varies between 0.5 mm and 2.0 mm.

* * * * *